US006241574B1

(12) United States Patent
Helbing

(10) Patent No.: US 6,241,574 B1
(45) Date of Patent: Jun. 5, 2001

(54) DEVICE TO INFLUENCE THE DRIVING PERFORMANCE OF A REMOTE-CONTROLLED MODEL VEHICLE

(76) Inventor: Ralf Helbing, Im Sixengarten 11, 86720 Nördlingen (DE)

( * ) Notice: Subject to any disclaimer, the term of this patent is extended or adjusted under 35 U.S.C. 154(b) by 0 days.

(21) Appl. No.: 09/269,827

(22) PCT Filed: Oct. 2, 1996

(86) PCT No.: PCT/EP96/04303

§ 371 Date: Apr. 1, 1999

§ 102(e) Date: Apr. 1, 1999

(87) PCT Pub. No.: WO98/14253

PCT Pub. Date: Apr. 9, 1998

(51) Int. Cl.[7] ..... A63H 30/00; A63H 30/04

(52) U.S. Cl. ..... 446/454; 446/456

(58) Field of Search ..... 446/436, 454, 446/456, 460, 431, 484

(56) References Cited

U.S. PATENT DOCUMENTS

| | | | | |
|---|---|---|---|---|
| 3,686,447 | * | 8/1972 | Takalo . | |
| 3,736,484 | * | 5/1973 | Reynolds et al. . | |
| 4,019,391 | | 4/1977 | Ljung . | |
| 4,143,307 | * | 3/1979 | Hansen et al. . | |
| 4,213,270 | * | 7/1980 | Oda | 446/454 |
| 4,644,793 | | 2/1987 | Church . | |
| 5,452,901 | * | 9/1995 | Nakada et al. | 446/454 |
| 5,465,620 | | 11/1995 | Sanderson et al. . | |
| 5,507,455 | * | 4/1996 | Yang | 244/190 |
| 5,667,420 | * | 9/1997 | Menow et al. | 446/433 |
| 5,762,533 | * | 6/1998 | Tilbor et al. | 446/466 |

FOREIGN PATENT DOCUMENTS

| | | |
|---|---|---|
| 077033PA | 2/1996 | (EP) . |
| 2 397 001 | 7/1977 | (FR) . |

* cited by examiner

*Primary Examiner*—D. Neal Muir
(74) *Attorney, Agent, or Firm*—Jaeckle Fleischmann & Mugel, LLP

(57) ABSTRACT

A device for influencing the handling characteristics of remote-controlled model cars or model ships, comprising a first input terminal for a first control signal which represents a first command variable which can be specified by a person who controls the vehicle, a sensor means which outputs a second control signal which represents a disturbance variable correlated with the rotational velocity or the lateral acceleration of the model vehicle, and a processing means which is connected with the first input terminal for receiving the first control signal and which has a second input terminal for receiving the second control signal, and which generates a first output signal which represents a first manipulated variable being a function of the first command variable and of the disturbance variable, with the first manipulated variable generated by the processing means being the command variable which as a function of the disturbance variable is limited or modified to a predeterminable degree.

14 Claims, 3 Drawing Sheets

DEVICE TO INFLUENCE THE DRIVING PERFORMANCE OF A REMOTE-CONTROLLED MODEL VEHICLE

The invention relates to a device for influencing the vehicle handling characteristics of remote-controlled model vehicles.

In current model vehicles, i.e. model cars or model ships, the problem is frequently encountered that the person who controls the vehicle guides the vehicle with excessive speed into a curve. As a consequence of this the vehicle is brought into an instable driving condition, i.e. the vehicle slithers out of the curve or begins to swerve (oversteering or understeering).

In view of the above, the invention is based on the object to prevent this.

In order to solve this object, the invention provides a device with two input terminals and a processing means. The first input terminal receives a first control signal that represents a first command variable. That variable may be set by a person who controls the vehicle. A sensor means on the vehicle generates a second control signal that represents a disturbance variable correlated with the rotational velocity or lateral acceleration of the model vehicle. The processing means is connected to the two input terminals. It receives the first and second control signals and generates a first output signal that is a first manipulated variable. The first manipulated variable depends upon and is a function of the first command signal and is limited or modified to a predetermined degree by the disturbance variable.

This device makes it possible to effectively prevent swerving of the vehicle in spite of an excessive steering angle or an excessive speed specified by the person who controls the vehicle.

The first user-specified command variable is preferably a steering arrangement drive signal. The first manipulated variable generated by the processing means is a signal that represents a change in magnitude and/or direction of the steering arrangement drive signal. It is, however, also possible that the first command variable is an acceleration or speed signal. In that case, the first manipulated variable generated by the processing means is a changed acceleration or speed signal. In either case, the command variable is under control of the user by operation of a conventional remote-controlled transmitter.

In addition, a third input terminal can be provided for receiving a further control signal representing a further command variable. That further command variable may also be specified by the user. In that case, the first output signal generated by the processing means represents a first manipulated variable which is a function of both the first command variable and the further command variable and the disturbance variable.

For this purpose, the device comprises a third input terminal for a further control signal. That further control signal represents a further command variable specified by the person controlling the vehicle. Moreover, the processing means generates a second output signal which represents a further manipulated variable which is a function of the first and/or the further command variable and of the disturbance variable.

Upon a change in magnitude and/or direction of the steering arrangement drive signal, a corresponding change in magnitude of the acceleration or speed signal is then preferably effected by the processing means. In addition, the amount of change of the acceleration or speed signal is influenced by the processing means as a function of the change in magnitude and/or direction of the steering arrangement drive signal. In a preferred embodiment of the invention adjustment means are provided by the processing means that adjusts the size of the rate of change of the acceleration or speed signal and/or the change in magnitude and/or direction inversion of the steering arraignment drive signal.

The processing means is adapted to reduce, limit, or invert the steering arrangement drive signal in a predetermined degree as a function of the sensor signal during cornering of the vehicle.

In an embodiment of the device according to the invention, the first sensor means is formed by a gyroscope, preferably a piezoelectric vibration gyroscope.

Alternatively, the first sensor means can also be formed by two acceleration sensors which are arranged in the vehicle at a distance from each other.

In order to be compatible with conventional remote control units the processing means is adapted to process and/or output signals of a predetermined shape. In particular, each of the first control signal, the steering arrangement drive signal and/or the acceleration or speed signal is a pulse-type signal with a duration of preferably 0.5 to 2.6 msec.

The above described device according to the invention is preferably structurally in a remote control receiver, in a model vehicle servo drive, and/or a model vehicle cruise control (speed control).

Although the device is described for model vehicles, the invention is not limited to same. The device according to the invention can also be employed for passenger cars or trucks.

Further advantageous embodiments, developments, properties and characteristics of the device according to the invention will become apparent from the following description of the figures.

Figure 1:
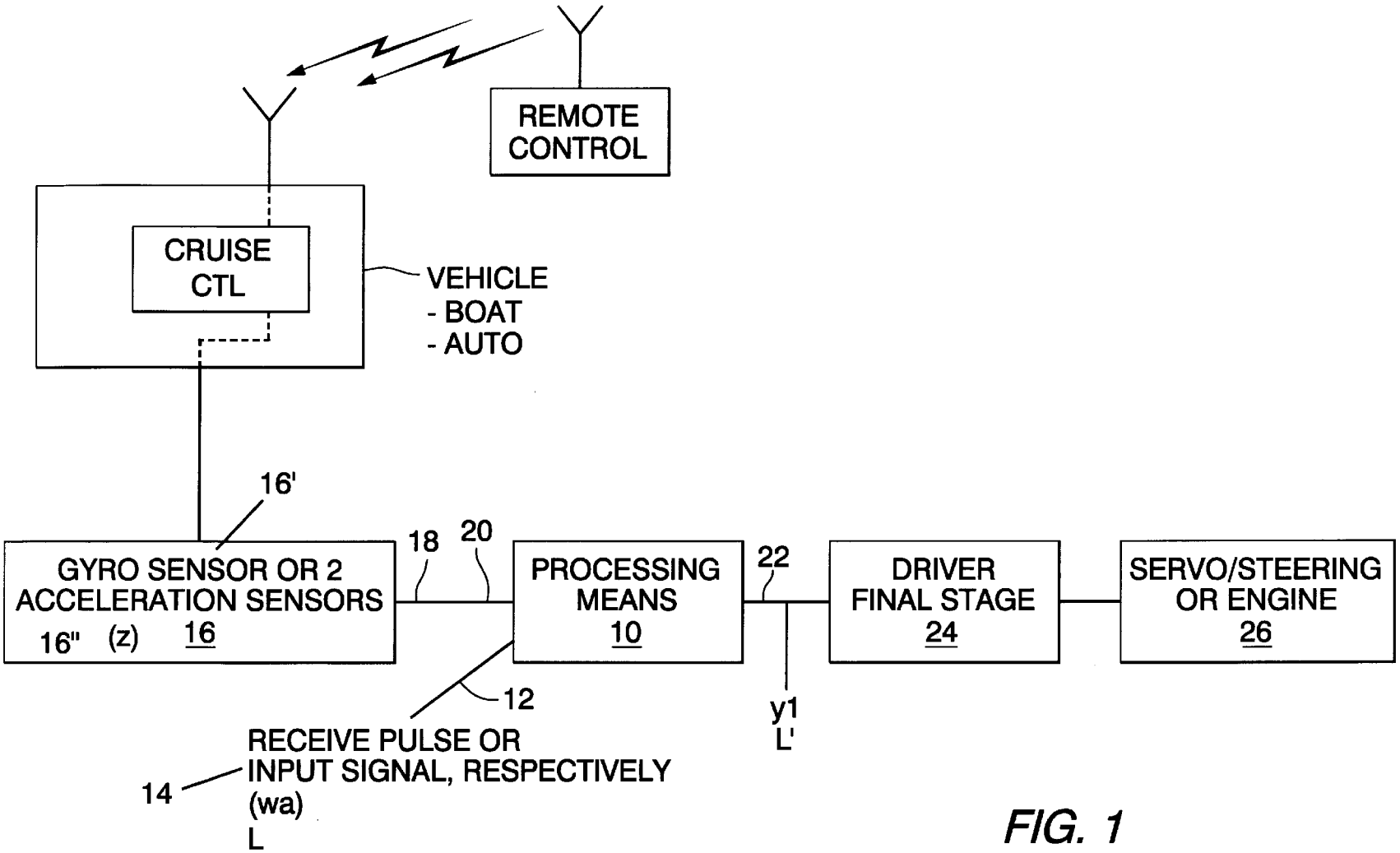
FIG. 1 shows a schematic block diagram of a device according to the invention in a model vehicle.

In FIG. 1, the device 10 according to the invention is designated as evaluation circuit with a first input terminal 12 for a first control signal 14 which represents a first command variable wa in the form of a steering input signal, which can be specified by a person who controls the vehicle.

A gyro sensor or two acceleration sensors form a sensor means 16 which outputs a second control signal 18 which represents a disturbance variable z which is correlated with the rotational velocity or the lateral acceleration of the model vehicle.

In addition, the device according to the invention has a processing means 10 that will be explained in more detail hereinafter. The processing means 10 is connected to the first input terminal 12 for receiving the first control signal 14. The processing means 10 is also connected to the second input terminal 20 for receiving the second control signal 18.

The processing means 10 generates a first output signal 22 which represents a first manipulated variable y1. The first manipulated variable y1 is a function of the first command variable wa and of the disturbance variable z. The first manipulated variable y1 modifies the command variable wa in accordance with and as a function of the disturbance variable z.

In the embodiment shown in FIG. 1, the first command variable wa is a user-specified steering arrangement drive signal L'. The first manipulated variable y1 generated by the processing means 10 is a changed and/or direction inverted steering arrangement drive signal L'. In other words, the input drive signal L is modified by the disturbance variable z to provide the modified steering drive signal L'. The modified steering arrangement drive signal L' is amplified in a drive stage 24 and is applied to a server motor 6 of the steering arrangement.

Figure 2:
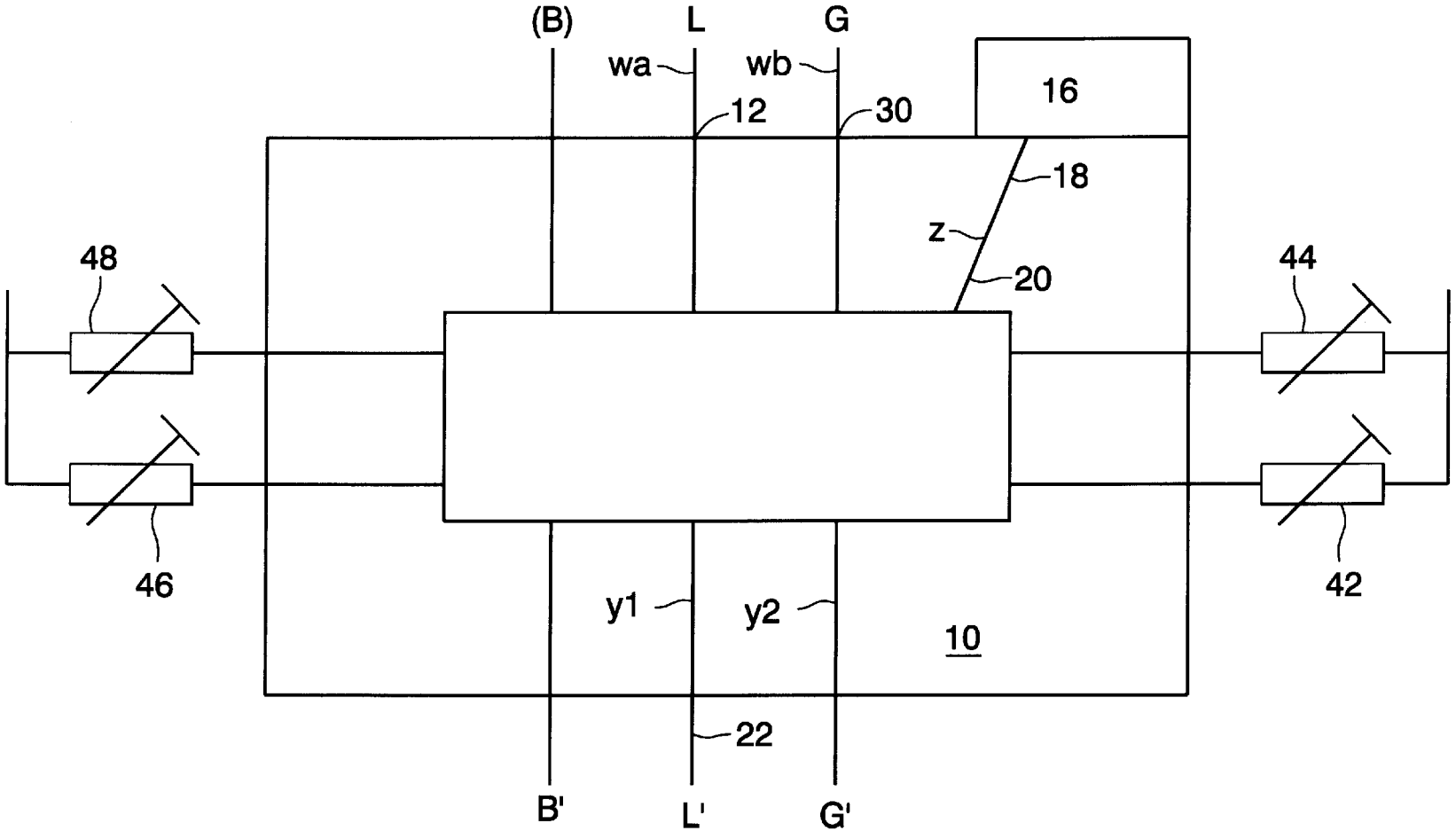
FIG. 2 shows a schematic block diagram of a device according to the invention in detail.

FIG. 2 shows a second embodiment of the invention. There, in addition to the steering signal L, a further signal, such as an acceleration signal G is processed. A third input terminal 30 on the processing means 10 receives the further control signal G. The control signal G is either a speed or acceleration signal that is defined by the user. In the figures, it is represented as a further command variable wb. The acceleration signal G sets the speed of a vehicle. This acceleration signal G is equivalent to the "set acceleration" signal found in conventional cruise controls for automobiles.

In addition, the first output signal generated by the processing means is influenced in such a manner that it represents a first manipulated variable y1 which is a function of the first and the second command variable wa, wb and of the disturbance variable z. In other words, the steering signal L' supplied to the steering arrangement by the servo motor is not only influenced by the first sensor 16 but, in addition, by the speed spcification signal G which is specified by the person controlling the vehicle.

In the embodiment shown in FIG. 2, a second output signal G' is generated by the processing means, which represents a further manipulated variable y2 which is a function of the first and the other command variable wa, wb and of the disturbance variable z. This means that in addition to the signal supplied to the servo motor of the steering arrangement, a further control signal for the speed of the drive motor (e.g. the engine throttle position in the case of a combustion engine) is provided. The further control signal is generated by the processing means 10 as a function of the steering angle signal L and the speed signal G as well as the signal from the sensor means 1*b*.

The processing means 10 is adapted to configure each of the output signals in such a manner that upon a change in magnitude and/or direction inversion of the steering arrangement drive signal L', a corresponding change in signal G' is effected as well.

For this purpose, the processing means 10 comprises adjusting means 42, 44 for establishing the amount and the rate of change in magnitude of the acceleration for speed signal G', as well as adjusting means 48, 46 for establishing the amount and the rate of change in magnitude and direction inversion of the steering arrangement drive signal by the processing means 10.

In the shown embodiment the adjusting means are illustrated by trimming potentiometers. This applies in particular if the device according to the invention and the processing means are an analog circuit (see also the following description of FIG. 3). It is, however, also possible, to implement the invention by means of a microcontroller. In this case, the adjusting means can each be implemented by eight DIP switches whose switch position is detected by the microcontroller and taken into consideration during the execution of the control program. Further user-specified signals (B) may be added The added signals (B) are suitably modified by the disturbance variable (z) and/or the other input signals L, G.

Regardless of whether an analog circuit or a microcontroller is employed, the processing means reduces, limits, or inverts the steering arrangement drive signal L and/or the speed specification signal in a predetermined degree during cornering of the vehicle as a function of the sensor signal and outputs same as a corresponding pulse-type signal G' or L', respectively, with a duration of preferably 0.5 to 2.6 msec.

Figure 3:
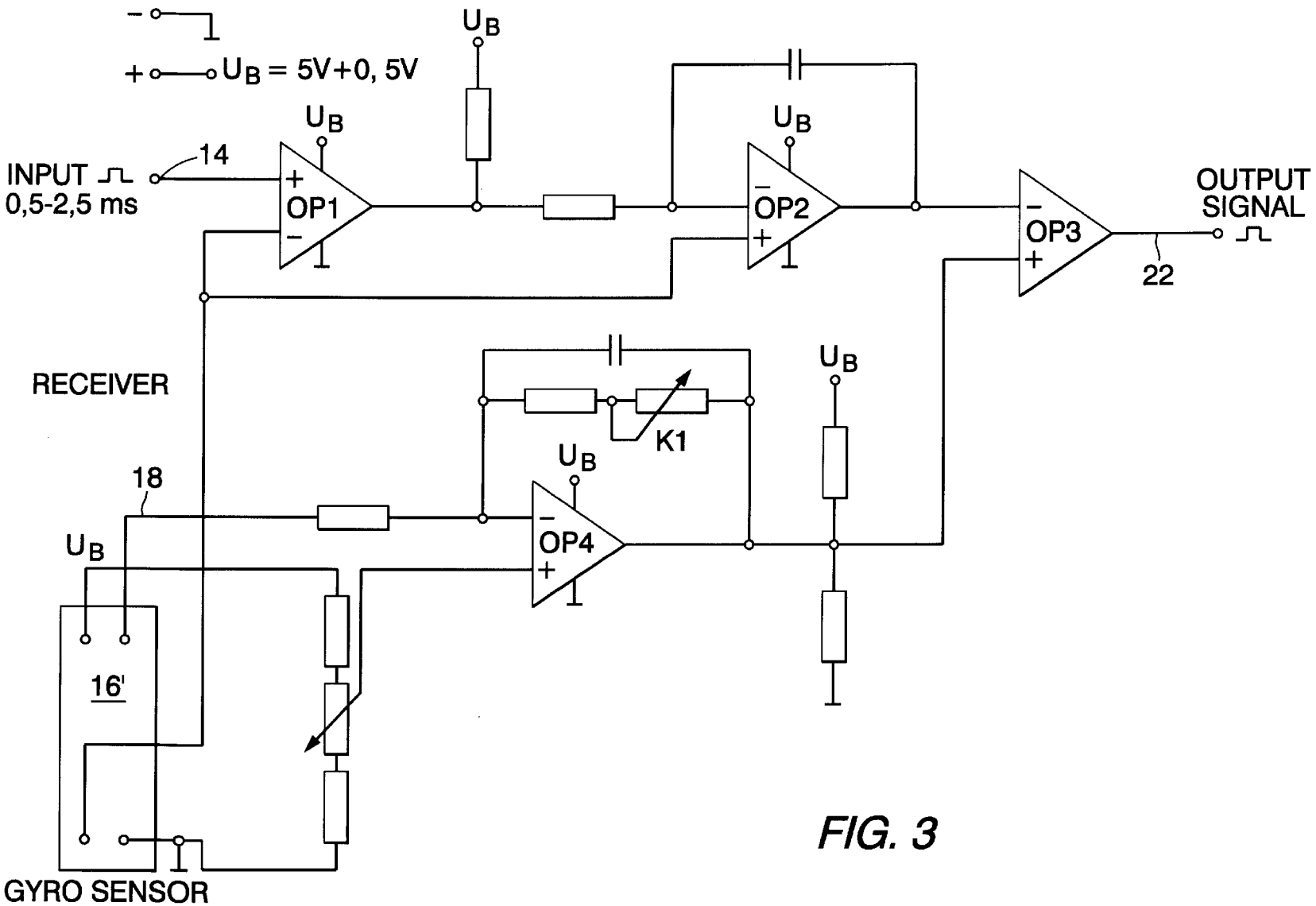
FIG. 3 shows a circuit diagram of an embodiment of a device according to the invention.

FIG. 3 shows a simple analog cicuit which embodies the essential characteristics of the invention. A reference voltage signal of 2.3 V±1.0 V generated by the gyro sensor 16 is compared with the input signal 14 by a first operation amplifier OP1 which is connected as a comparator. The output signal of the comparator is supplied to the inverting input of an operation amplifier OP2 which is connected as an integrator, while the signal from the gyro sensor is supplied to the non-inverting input of said integrator. The output signal of the integrator is supplied to the non-inverting input of an operation amplifier OP3 which operates as a comparator, while a pulse signal with a band width of 50 Hz generated by the gyro sensor is amplified in an operation amplifier OP4 and supplied to the inverting input of the operation amplifier OP3. The output signal of the operation amplifier OP3 is supplied to the final stage 24 in FIG. 1. The operation amplifier OP4 has a trimming potentiometer K1 in its feedback branch, via which the gain can be adjusted.

The gyro sensor outputs a signal which corresponds to the rotation of the vehicle (1.11 mV/DEG/sec). This variable which corresponds to the rotational velocity of the vehicle is utilized for determining to which extent countersteering is to be effected. During cornering the steering angle is reduced as a function of the trimmer position K1.

The steering servo position can also be made dependent on other factors in addition to the steering input signal and/or the acceleration/braking signal.

What is claimed is:

1. A device for influencing the handling characteristics of remotely-controlled model vehicle, in particular a model car or model ship, comprising:

a first input terminal (12) for receiving a first control signal (19) representing a first user-specified command variable (wa) for the vehicle, a sensor means (16) for generating a second control signal (18) representing a disturbance variable (z) correlated with angular velocity or lateral acceleration of the vehicle, and a processing means for receiving the first and second control signals (14,18) and for generating a first output signal (22) representing a first manipulated variable (y1) which corresponds to the first command variable (wa) modified to a predetermined degree as a function of the disturbance variable (z), said first output signal (22) being adapted to avoid an unstable driving condition for the vehicle.

2. A device for influencing the handling characteristics of a remotely-controlled model vehicle according to claim 1, wherein:

the first user-specified command variable (wa) is an input steering signal (L), and the first manipulated variable (y1) which the first output signal (22) of the processing means represents is a modified steering signal (L').

3. A device for influencing the handling characteristics of a remotely-controlled model vehicle according to claim 1, wherein:

the first user-specified command variable (wa) is an input acceleration or speed signal (G), and the first manipulated variable (y1) which the First output signal (22) of the processing means represents is a modified acceleration or speed signal (G').

4. A device for influencing the handling characteristics of a remotely-controlled model vehicle according to claim 1, comprising:

a further input terminal (30) for receiving a third control signal representing a second user-specified command variable (wb) for the vehicle, wherein the processing means receives the third control signal and generates the first output signal (22) as a function of both the first and second command variables (wa,wb) and the disturbance variable (z).

5. A device for influencing the handling characteristics of a remotely-controlled model vehicle according to claim 4, wherein:

the processing means generates a second output signal representing a second manipulated variable (y2) corresponding to the second command variable (wb) modified to a predetermined degree as a function of the disturbance variable (z), said second output signal being adapted to avoid an unstable driving condition for the vehicle.

6. A device for influencing the handling characteristics of a remotely-controlled model vehicle according to claim 5, wherein:

the first user-specified command variable (wa) is an input steering signal (L), and the first manipulated variable (y1) which the first output signal (22) of the processing means represents is a modified steering signal (L').

7. A device for influencing the handling characteristics of a remotely-controlled model vehicle according to claim 6, wherein:

the second user-specified command variable (wb) is an input acceleration or speed signal (G), and the second manipulated variable (y2) which the second output signal of the processing means represents is a modified acceleration or speed signal (G').

8. A device for influencing the handling characteristics of a remotely-controlled model vehicle according to claim 7, wherein:

upon a limitation and/or direction inversion of the input steering signal (L), a limitation of the acceleration or speed signal is also effected by the processing means.

9. A device for influencing the handling characteristics of a remotely-controlled model vehicle according to claim 1, further comprising:

adjusting means (42, 44) to set the predetermined degree of modification of the first manipulated variable (y1) generated by the processing means.

10. A device for influencing the handling characteristics of a remotely-controlled model vehicle according to claim 1, wherein:

the first manipulated variable (y1) is generated during cornering of the vehicle.

11. A device for influencing the handling characteristics of a remotely-controlled model vehicle according to claim 1, wherein:

the sensor means (16) is a piezo-electric vibration gyroscope.

12. A device for influencing the handling characteristics of a remotely-controlled model vehicle according to claim 1, wherein:

the sensor means (16) is formed by two acceleration sensors which are arranged in the vehicle at a distance from each other.

13. A device for influencing the handling characteristics of a remotely-controlled model vehicle according to claim 1, wherein:

one of the first control signal, the second control signal and the first output signal is a pulse-type signal with a duration in the range of 0.5 to 2.6 msec.

14. A device for influencing the handling characteristics of a remotely-controlled model vehicle according to claim 1, wherein:

said device is structurally integrated within the vehicle in one of a remote control receiver, a model vehicle servo drive, and a model vehicle cruise control.

* * * * *